US008956169B2

(12) United States Patent
Shinder-Lerner et al.

(10) Patent No.: US 8,956,169 B2
(45) Date of Patent: Feb. 17, 2015

(54) SELF-ADJUSTING COAXIAL CONTACT

(71) Applicants: Arkady Shinder-Lerner, Framingham, MA (US); Eric R. Stauble, Groveland, MA (US); David E. Salomon, Southborough, MA (US); Francesco Nania, Clinton, MA (US)

(72) Inventors: Arkady Shinder-Lerner, Framingham, MA (US); Eric R. Stauble, Groveland, MA (US); David E. Salomon, Southborough, MA (US); Francesco Nania, Clinton, MA (US)

(73) Assignee: Hypertronics Corporation, Hudson, MA (US)

( * ) Notice: Subject to any disclaimer, the term of this patent is extended or adjusted under 35 U.S.C. 154(b) by 9 days.

(21) Appl. No.: 14/025,670

(22) Filed: Sep. 12, 2013

(65) Prior Publication Data

US 2014/0073160 A1 Mar. 13, 2014

Related U.S. Application Data

(60) Provisional application No. 61/700,001, filed on Sep. 12, 2012.

(51) Int. Cl.

| | |
|---|---|
| ***H01R 12/91*** | (2011.01) |
| ***H01R 9/05*** | (2006.01) |
| ***H01R 24/50*** | (2011.01) |
| *H01R 12/73* | (2011.01) |

(52) U.S. Cl.

CPC ..... *H01R 9/0515* (2013.01); *H01R 12/91* (2013.01); *H01R 24/50* (2013.01); *H01R 12/73* (2013.01)

USPC ..... 439/248

(58) Field of Classification Search

USPC ..... 439/246, 248, 578, 582, 585, 63, 350, 439/675

See application file for complete search history.

(56) References Cited

U.S. PATENT DOCUMENTS

| | | | | | |
|---|---|---|---|---|---|
| 3,047,828 | A | * | 7/1962 | Gregson et al. | 439/248 |
| 3,566,334 | A | * | 2/1971 | Ziegler, Jr. | 439/248 |
| 3,845,453 | A | * | 10/1974 | Hemmer | 439/578 |
| 4,326,769 | A | * | 4/1982 | Dorsey et al. | 439/21 |
| 4,929,188 | A | * | 5/1990 | Lionetto et al. | 439/349 |
| 4,943,245 | A | * | 7/1990 | Lincoln | 439/578 |
| 5,074,809 | A | * | 12/1991 | Rousseau | 439/675 |
| 5,147,221 | A | * | 9/1992 | Cull et al. | 439/585 |
| 5,203,813 | A | * | 4/1993 | Fitzsimmons et al. | 29/876 |
| 5,769,652 | A | * | 6/1998 | Wider | 439/248 |

(Continued)

FOREIGN PATENT DOCUMENTS

| | | |
|---|---|---|
| JP | 07-235349 | 9/1995 |
| JP | 2001-307843 | 11/2001 |
| JP | 3725928 | 12/2005 |

*Primary Examiner* — Alexander Gilman

(74) *Attorney, Agent, or Firm* — Snell & Wilmer LLP

(57) ABSTRACT

A self-adjusting mated pair connector having a conductive flexible wire and a retaining ring to facilitate electrical connections through the mated pair connector. A receptacle assembly rigidly and electrically connects a portion of the receptacle assembly to a receptacle PCB. A plug assembly rigidly and electrically connects a portion of the plug assembly to a plug PCB. During mating of the receptacle assembly and the plug assembly, the flexible wire and retaining ring allow for floating or movement of a portion of the receptacle assembly and/or plug assembly without stressing or damaging the rigid electrical connections with the receptacle PCB and the plug PCB or the connector interfaces. Electrical conductivity can be maintained without needing to angle the entire receptacle assembly and/or plug assembly during misalignment in the mating process. Impedance matching and low inductance of the mated pair connector may allow for desired electrical performance.

20 Claims, 7 Drawing Sheets

(56) References Cited

U.S. PATENT DOCUMENTS

| | | | | |
|---|---|---|---|---|
| 6,102,746 | A * | 8/2000 | Nania et al. | 439/675 |
| 6,379,183 | B1 * | 4/2002 | Ayres et al. | 439/578 |
| 6,439,925 | B1 * | 8/2002 | Lin et al. | 439/578 |
| 6,464,546 | B2 * | 10/2002 | LaCoy | 439/847 |
| 6,497,579 | B1 * | 12/2002 | Garbini | 439/63 |
| 6,709,289 | B2 * | 3/2004 | Huber et al. | 439/578 |
| 6,848,922 | B2 * | 2/2005 | Coughlan et al. | 439/181 |
| 7,018,216 | B1 * | 3/2006 | Clark et al. | 439/63 |
| 7,455,550 | B1 * | 11/2008 | Sykes | 439/584 |
| 7,547,215 | B1 * | 6/2009 | Mark et al. | 439/66 |
| 7,563,133 | B2 * | 7/2009 | Stein | 439/578 |
| 7,677,924 | B2 * | 3/2010 | Schuster et al. | 439/578 |
| 7,857,651 | B2 * | 12/2010 | Chen | 439/352 |

* cited by examiner

SELF-ADJUSTING COAXIAL CONTACT

CROSS-REFERENCE TO RELATED APPLICATION

This application claims the benefit and priority of U.S. Provisional Application No. 61/700,001, filed on Sep. 12, 2012, entitled "Self-Adjusting Coaxial Contact," which is hereby incorporated by reference in its entirety.

BACKGROUND

1. Field

The present disclosure relates generally to electrical connectors and improvements thereto. More particularly, the present disclosure relates to mated pair coaxial connectors configured to mate in an offset position and improvements thereto.

2. Description of the Related Art

Electrical connectors for interfacing between separated systems or electronic devices are widely used in the art. Conventional electrical connectors utilize a series of pins on a first half of the connector and a corresponding series of sockets on a second half of the connector. When the two halves are mated together, the sockets receive the pins in order to electrically connect and provide a conductive pathway through the electrical connector. Thus, when one system or electronic device is electrically coupled with the pins of the first half of the connector and a second system or electronic device is electrically coupled with the sockets of the second half of the connector, the two systems or devices may be electrically connected through the mated connector. Commonly, one or both halves of the connector are rigidly fastened with solder to printed circuit board ("PCB") terminations, thus allowing signal propagation from one PCB to another.

Unfortunately, these rigid PCB connections as well as the connector interfaces can be easily damaged during mating of the pins of the first half of the mated pair connector to the sockets of the second half of the mated pair connector if even a small amount of misalignment exists between the two halves. Breaking the electrical connection at the PCB can result in malfunction of the equipment, damage to connecting systems or even pose significant safety concerns depending upon the operation of the circuit being interrupted. Moreover, as systems and devices increase in complexity, higher density electrical connectors capable of electrically connecting increasingly large numbers of signals with one another are used, further increasing the potential for even a single misalignment between a pin and a socket.

Some attempts to mitigate these risks have been made through the use of connectors that allow for some movement or self-alignment via spring elements during mating to protect the rigid PCB connections from suffering damage or breakage. However, such connectors introduce various problems for the circuit or signal integrity, including, for example, additional inductance and increased complications in impedance matching. These issues make the electrical connectors undesirable or impossible for a variety of circuits that require specific operational characteristics. Therefore, a need exists for an improved mated pair electrical connector that would allow for self-adjustment to combat potential misalignment during mating. Ideally, such an electrical connector would have a flexible or scalable design capable of a variety of configurations, would be inexpensive to manufacture, would be safe to use, and would allow for improved impedance matching or low interference with desired operational parameters.

SUMMARY

A mated pair electrical connector utilizing a flexible element for providing a self-adjusting and low cost solution to facilitate an electrical connection during misalignment in mating is disclosed.

In one implementation, a mated pair electrical connector for providing electrical conductivity between a first printed circuit board and a second printed circuit board may include a plug assembly configured to rigidly connect to the first printed circuit board. The plug assembly may have a plug mating end with a plug outer conductor defining a cavity therein, an inner pin disposed within the cavity, a flexible wire connected to the inner pin, as well as a plug PCB end with a rear tail surrounding the flexible wire and coupled to the outer conductor via a retaining ring, the retaining ring configured to allow movement of the plug outer conductor with respect to the rear tail. The electrical connector may also include a receptacle assembly configured to rigidly connect to the second printed circuit board. The receptacle assembly may have a receptacle outer conductor defining a cavity therein, a wire basket disposed within the cavity and configured to engage the plug outer conductor and apply a force to the plug outer conductor for the moving of the plug outer conductor with respect to the rear tail when the plug assembly is mated with the receptacle assembly, and a conductive socket wire basket disposed within the cavity and configured to receive the inner pin when the plug assembly is mated with the receptacle assembly.

In another implementation, an electrical connector comprises a plug assembly having a plug central axis. The plug assembly comprises: a plug outer body defining a plug cavity therein, a conductive pin disposed within the plug cavity, a dielectric insulator disposed around the conductive pin and separating the conductive pin from the plug outer body, a conductive flexible wire connected to the conductive pin, a flexible material disposed around the conductive flexible wire, a rear tail movably connected to the plug outer body independent of the conductive flexible wire via a retaining ring such that the plug outer body can float with respect to the rear tail, a first plug protrusion connected to the rear tail, and a second plug protrusion connected to the conductive flexible wire. The electrical connector also comprises a receptacle assembly having a receptacle central axis. The receptacle assembly comprises a receptacle outer body defining a receptacle cavity therein, a wire basket disposed within the receptacle cavity and configured to engage the plug outer body and apply a force to the plug outer body such that the plug outer body shifts to allow the plug central axis to align with the receptacle central axis, a conductive socket wire basket disposed within the receptacle cavity and configured to receive the conductive pin, a first receptacle protrusion connected to the receptacle outer body, and a second receptacle protrusion electrically connected to the conductive socket wire basket.

In yet another implementation, an electrical connector comprises a plurality of plug assemblies and a plurality of respective receptacle assemblies. Each of the plurality of plug assemblies comprises a plug outer conductor defining a cavity therein, an inner pin disposed within the cavity, a flexible wire connected to the inner pin, and a rear tail surrounding the flexible wire and coupled to the outer conductor via a retaining ring. The retaining ring is configured to allow movement of the plug outer conductor with respect to the rear tail. Each of the plurality of receptacle assemblies comprises a receptacle outer conductor defining a cavity therein, a wire basket disposed within the cavity and configured to engage the respective plug outer conductor and apply a force to the respective plug outer conductor for the moving of the respective rear tail with respect to the respective plug outer conductor when the respective plug assembly is mated with the receptacle assembly, and a conductive socket wire basket disposed within the cavity and configured to receive the respective inner pin when the respective plug assembly is mated with the receptacle assembly.

BRIEF DESCRIPTION OF THE DRAWINGS

Other systems, methods, features, and advantages of the present disclosure will be or will become apparent to one with skill in the art upon examination of the following figures and detailed description. It is intended that all such additional systems, methods, features, and advantages be included within this description, be within the scope of the present disclosure, and be protected by the accompanying claims. Component parts shown in the drawings are not necessarily to scale, and may be exaggerated to better illustrate the important features of the present disclosure. In the drawings, like reference numerals designate like parts throughout the different views, wherein:

DETAILED DESCRIPTION

Figure 1:
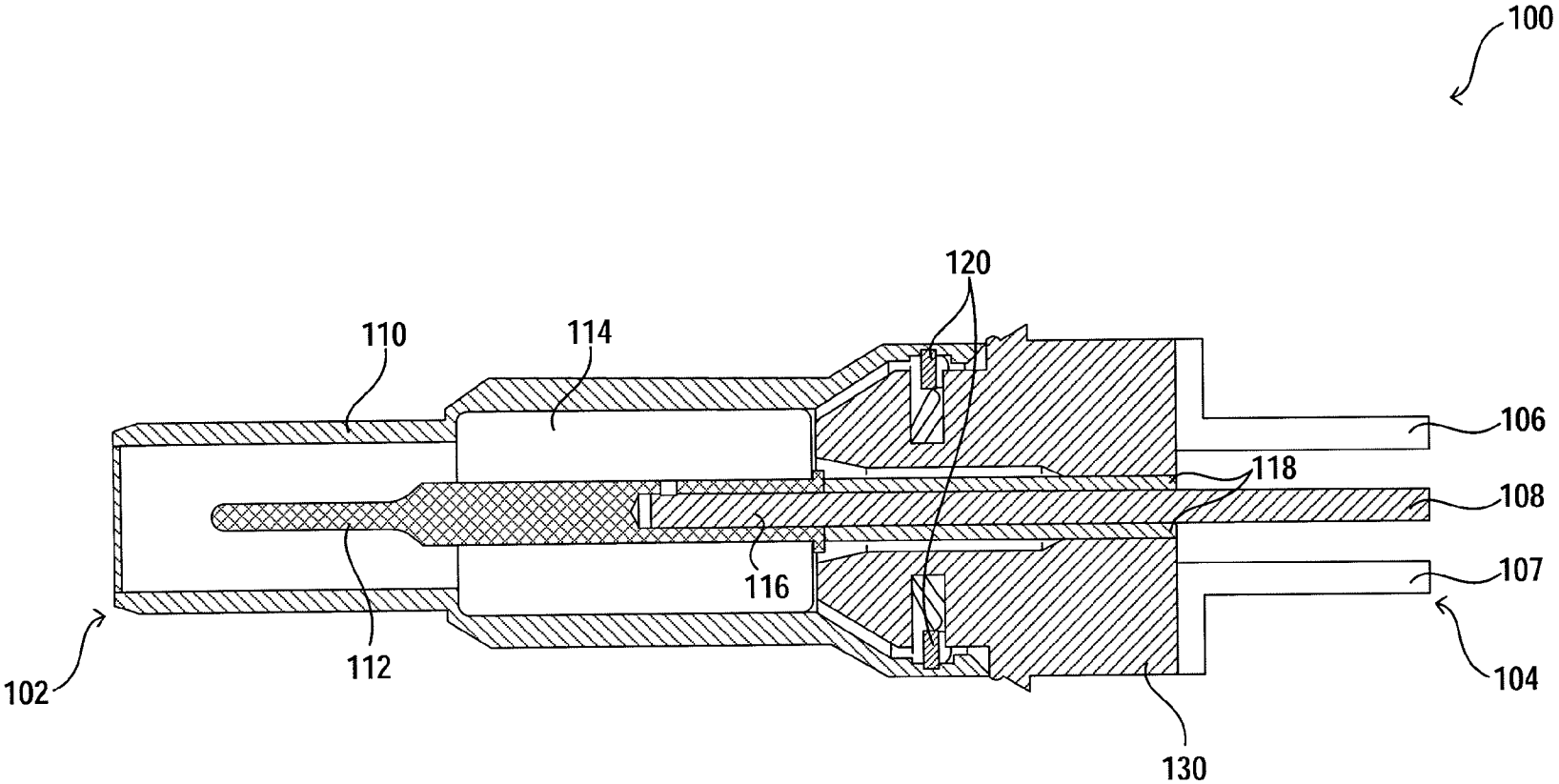
FIG. 1 is a cut-away side view of a plug assembly of an electrical connector configured to self-adjust during mating according to an implementation of the present disclosure.

Referring first to FIG. 1, a cut-away side view of a plug assembly 100 of an electrical connector is shown. The plug assembly 100 has a plug mating end 102 and a plug PCB end 104. The plug PCB end 104 of the plug assembly may be configured to rigidly secure and make electrical contact with a plug PCB (not shown). The plug PCB end 104 has a plurality of protrusions (106, 107, 108) or conductive elements extending outwardly for making electrical connection with the plug PCB. For example, the protrusions (106, 107) may be used for carrying a ground signal between ground traces on the plug PCB and an outer shell or ground portion of the plug assembly 100. The protrusion 108 may be used for carrying an electrical signal between the plug PCB, through the plug assembly 100 for connection to a corresponding receptacle assembly, as discussed in greater detail herein.

The plug assembly 100 includes an outer conductor 110 that defines a cavity therein. The outer conductor 110 may be made of a variety of conductive materials (e.g., copper) for carrying an electrical signal. In an alternative implementation, the outer conductor 110 may replaceably be a non-conductive outer body of the plug assembly 100 if it is not desired to propagate or transmit electrical signals therealong. As shown, the outer conductor 110 may have a bullet-nose shape or configuration for assisting in the acceptance of the outer conductor 110 with a corresponding receptacle assembly, as discussed in greater detail herein. However, an alternative implementation may utilize any of a variety of shapes or configurations for the outer conductor 110. A conductive inner pin 112 is disposed within the cavity of the outer conductor 110. A dielectric insulator 114 is disposed around the inner pin 112 and separates the inner pin 112 from the outer conductor 110. Thus, electrical signals present on the outer conductor 110 and/or the inner pin 112 are kept isolated from one another and electrical interference or signal degradation is reduced or mitigated.

A flexible wire 116 is electrically connected to the inner pin 112 (e.g., via an internal connection within the inner pin 112) and acts as a portion of the protrusion 108 for electrically connecting with a conductive trace or portion of the PCB. In various implementations, the protrusion 108 may be removably attached to plug PCB end 104 by insertion of a flexible wire 116. In an alternative implementation, the flexible wire 116 may be a separate component from the protrusion 108 and electrically connect with the protrusion 108 for passing signals between the inner pin 112 and the protrusion 108. The flexible wire 116 is made of a conductive material (e.g., copper) and is surrounded by a flexible, non-conductive material 118, for example, Teflon®. Teflon® may provide for improved impedance matching compared to other non-conductive materials.

The flexible wire 116 allows portions of the plug assembly 100 to shift position during a mating process with a receptacle assembly while still maintaining electrical conductivity between the protrusion 108 and the inner pin 112, as discussed in greater detail herein. Thus, the electrical connector allows for mating of the plug assembly 100 and a corresponding receptacle assembly even if the plug assembly and the corresponding receptacle assembly are not precisely aligned. In this manner, damage to any connected PCB or other electrical component is avoided when misalignment occurs. In addition, costly re-manufacturing or re-design of systems utilizing mated electrical connections is reduced since the error tolerance in lining up the mating portions is increased. By utilizing the flexible wire 116 in place of a spring component for facilitating electrical conductivity, a more reliable electrical connection may be realized, with lower inductances and better impedance matching (e.g., 50±5 ohms) than may otherwise be obtained.

The plug assembly 100 also includes a rear tail 130 that is fixedly engaged with the protrusions (106, 107). The outer conductor 110 is moveably coupled to the rear tail 130 via an internal retaining ring 120, the rear tail surrounding the flexible wire 116. Thus, the retaining ring 120 provides a mechanical connection for holding a front and rear portion of the plug assembly 100 together, independent of the flexible wire 116. Such a connection also maintains electrical conductivity between the rear tail 130 and the outer conductor 110 via the retaining ring 120 and allows the outer conductor 110 the ability to translate or float about the rear tail 130 without needing to angle the entire plug assembly 100. Such a configuration may provide for a more robust and/or stable connector, particularly for use in harsher environments. This configuration also aids in preventing dust, moisture or other environmental elements from entering the plug assembly 100 and interfering with its mechanical or electrical operation. The retaining ring allows for angling and/or shifting of a central axis of the plug assembly 100 in order to accommodate the movement or floating of portions of the plug assembly 100 when connecting with a corresponding receptacle assembly that is not precisely aligned with the central axis of the plug assembly 100, as seen in greater detail herein. In one implementation, the retaining ring 120 may be a wave washer.

Figure 2:
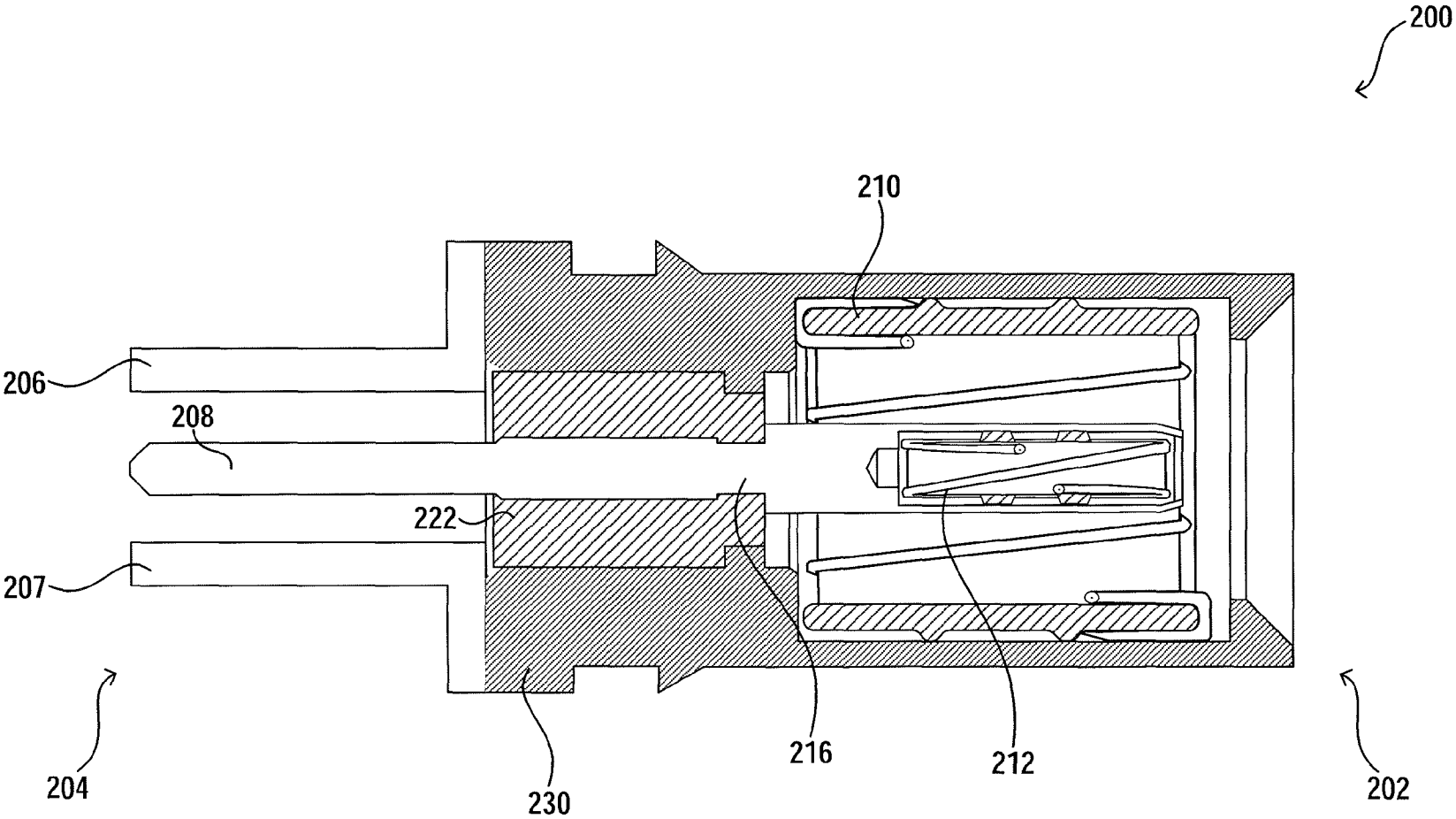
FIG. 2 is a cut-away side view of a receptacle assembly of an electrical connector according to an implementation of the present disclosure.

Referring next to FIG. 2, a side view of a receptacle assembly 200 of an electrical connector is shown. The receptacle assembly 200 has a receptacle mating end 202 and a receptacle PCB end 204. The receptacle PCB end 204 of the receptacle assembly may be configured to rigidly secure and make electrical contact with a receptacle PCB (not shown). The receptacle PCB end 204 has a plurality of protrusions (206, 207, 208) or conductive elements extending outwardly for making electrical connection with the receptacle PCB. For example, the protrusions (206, 207) may be used for carrying a ground signal between ground traces on the receptacle PCB and an outer shell or ground portion of the receptacle assembly 200. The protrusion 208 may be used for carrying an electrical signal between the receptacle PCB, through the receptacle assembly 200 for connection to a corresponding plug assembly, as discussed in greater detail herein. The receptacle mating end 202 of the receptacle assembly 200 is configured or adapted to accept or receive a portion of a plug assembly (e.g., the plug assembly 100 of FIG. 1). In one implementation, the receptacle mating end 202 may be formed in a hyperboloid shape or configuration. Other shapes or configurations may be utilized in alternative implementations. Thus, an electrical signal present on the receptacle PCB may be propagated along the protrusion 208, through the receptacle assembly 200 for connection to a mated plug assembly.

The receptacle assembly 200 includes an outer conductor 230 that defines a cavity therein. The outer conductor 230 may be made of a variety of conductive materials (e.g., copper) for carrying an electrical signal. In an alternative implementation, the outer conductor 230 may replaceably be a non-conductive outer body of the receptacle assembly 200 if it is not desired to propagate or transmit electrical signals therealong. A wire basket 210 is disposed within the cavity defined by the outer conductor 230 and is electrically connected with the outer conductor 230 for providing a surface for an outer conductor of a plug assembly (e.g., the outer conductor 110 of FIG. 1) to contact during mating. A wire basket in accordance with various implementations may comprise multiple components, such as ferrule wound with a wire. The wire basket 210 provides a flexible, conductive surface for the outer conductor of the plug assembly (see FIG. 1) to apply a force for shifting a portion of the plug assembly (e.g., the outer conductor 110 of FIG. 1 shifts relative to the rigidly fixed rear tail 130 of FIG. 1) in order to align the plug assembly with the receptacle assembly 200. Thus, the connection wear that can otherwise occur if an inflexible surface were used in place of the wire basket 210 is avoided and the durability of the receptacle assembly 200 and/or a corresponding plug assembly is dramatically extended.

A conductive socket wire basket 212 is also disposed within the cavity defined by the outer conductor 230 and is configured to receive an inner pin of a plug assembly (e.g., the inner pin 112 of FIG. 1) when the receptacle assembly 200 is mated with the plug assembly. The conductive socket wire basket 212 is electrically connected to the protrusion 208 via a conductive portion or element 216. In certain implementations, the protrusion 208 may be the same component as the conductive portion or element 216. In an alternative implementation, a separate conductive portion or element 216 may couple between the protrusion 208 and the conductive socket wire basket 212 in order to electrically connect them. A non-conductive element 222 is disposed around the conductive portion or element 216 in order to separate and isolate signals being propagated along the outer conductor 230 and the conductive portion or element 216.

Figure 3B:
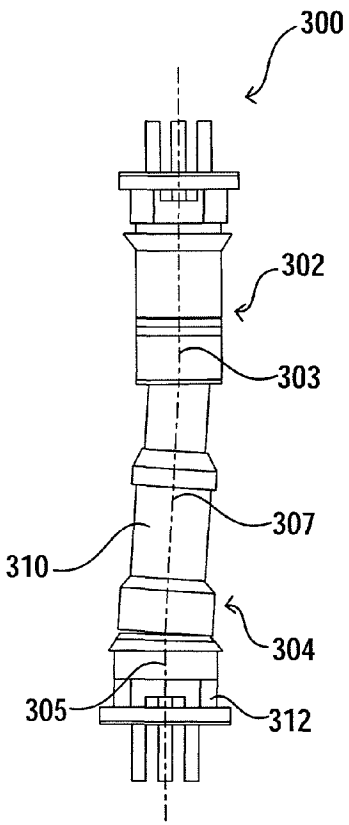
FIG. 3B is a side view of the plug assembly and the receptacle assembly of the self-adjusting electrical connector of FIG. 3A during an intermediate stage in a mating process according to an implementation of the present disclosure.
Figure 3A:
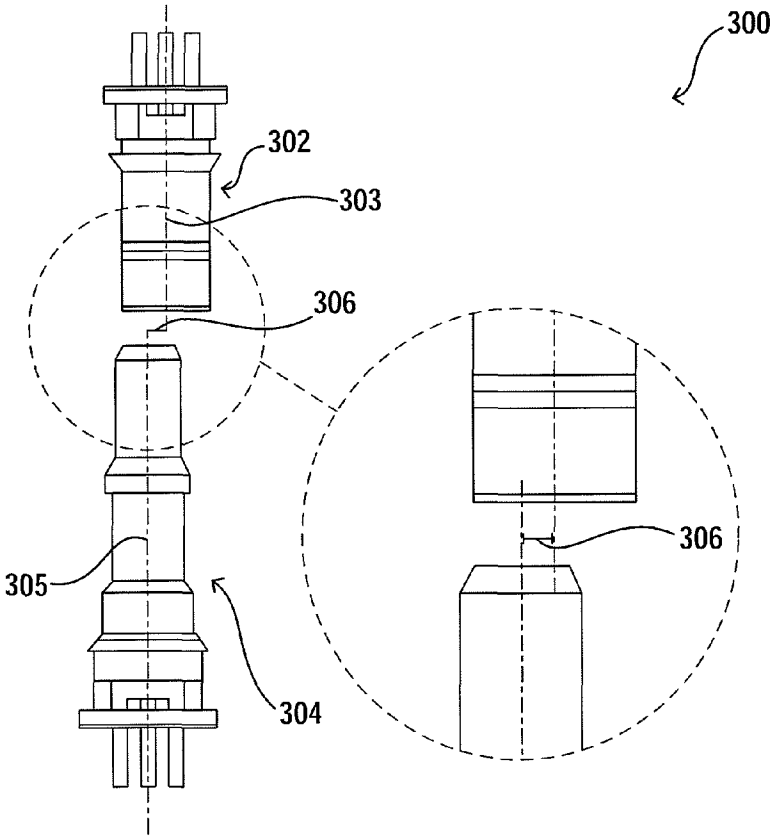
FIG. 3A is a side view of a plug assembly and a receptacle assembly of a self-adjusting electrical connector prior to mating according to an implementation of the present disclosure.
Figure 3C:
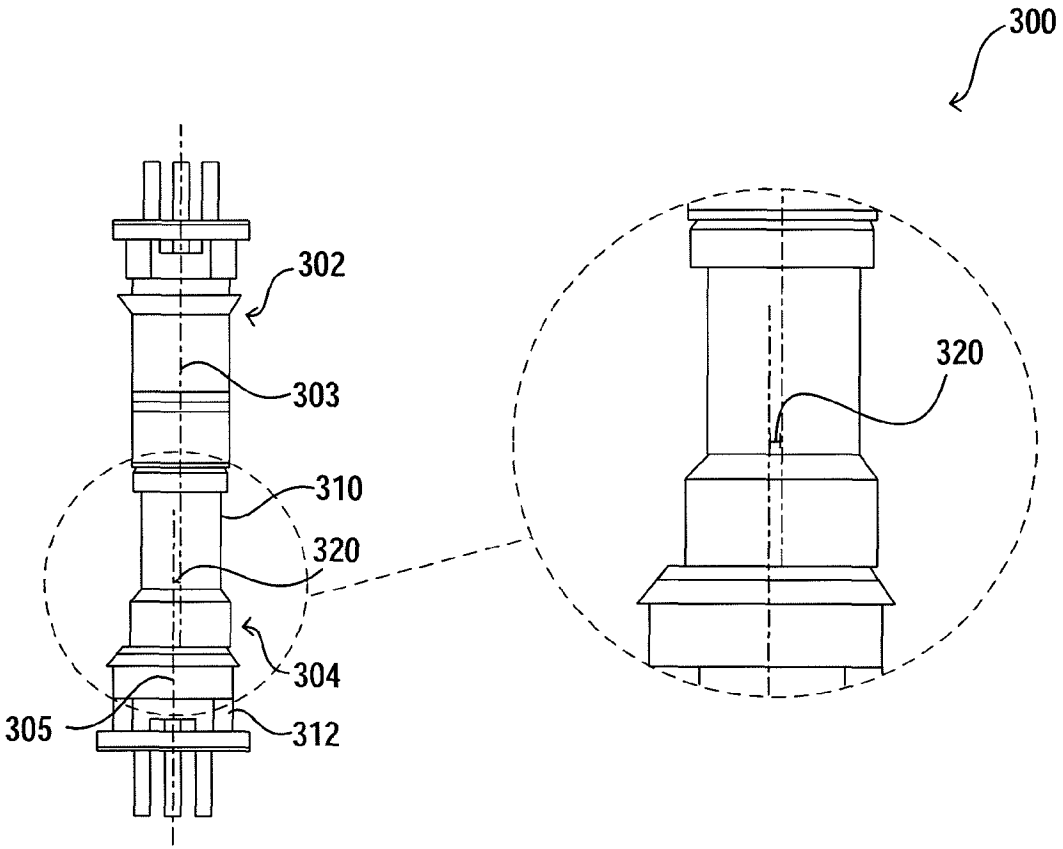
FIG. 3C is a side view of the plug assembly and the receptacle assembly of the self-adjusting electrical connector of FIG. 3A during a final stage in the mating process, or fully mated, according to an implementation of the present disclosure.

Turning next to FIGS. 3A-3C, a plurality of side views of a self-adjusting electrical connector 300 during various stages of a mating process are shown. In FIG. 3A, the self-adjusting electrical connector 300 is shown in an unmated configuration. A receptacle assembly 302 is separated from a corresponding plug assembly 304. The receptacle assembly 302 is shown having a central axis 303 that is misaligned by an offset 306 from a central axis 305 of the plug assembly 304. Thus, a conventional electrical connector would put strain on any connected PCBs rigidly fastened to the receptacle assembly 302 and/or the plug assembly 304 if the receptacle assembly 302 was forced to mate with the plug assembly 304 in the mis-aligned state.

In FIG. 3B, the self-adjusting electrical connector 300 of FIG. 3A is shown during an intermediate stage of the mating process. The plug assembly 304 has a first portion 312 that may be rigidly fastened with a PCB and a second portion 310 that is permitted to move or shift position or orientation with respect to the first portion 312. As shown, when the receptacle assembly 302 begins to receive the second portion 310 of the plug assembly 304, the second portion 310 begins to angle 307 towards alignment with the central axis 303 of the receptacle assembly 302. The central axis 303 of the receptacle assembly 302 and the central axis 305 of the first portion 312 of the plug assembly are thus not disturbed during mating of the misaligned electrical connector 300. Likewise, the connector interface is not affected by the misalignment due to the ability of electrical connector 300 to self-correct misalignment. In this manner, potential damage to electrical connections made with self-adjusting electrical connector 300 is prevented.

In FIG. 3C, the self-adjusting electrical connector 300 of FIGS. 3A and 3B is shown during a final stage of the mating process, i.e. fully mated. The central axis 303 of the receptacle assembly 302 is now in alignment with a central axis of the second portion 310 of the plug assembly 304. Neither the central axis 303 of the receptacle assembly 302 nor the central axis 305 of the first portion 312 of the plug assembly 304 has shifted or been put under strain during mating of the misaligned electrical connector 300. Instead, the offset 306 originally existing between the receptacle assembly 302 and the plug assembly 304 (see FIG. 3A) has been accommodated by shifting the second portion 310 of the plug assembly 304 with respect to the first portion 312 of the plug assembly. Thus, an offset 320 in the same or similar amount as offset 306 instead exists between the central axis 305 of the first portion 312 of the plug assembly 304 and the central axis of the second portion 310 of the plug assembly 304. The central axis of the second portion 310 of the plug assembly 304 is now in alignment with the central axis 303 of the receptacle assembly 302, permitting the desired electrical conductivity through the electrical connector 300.

Figure 4A:
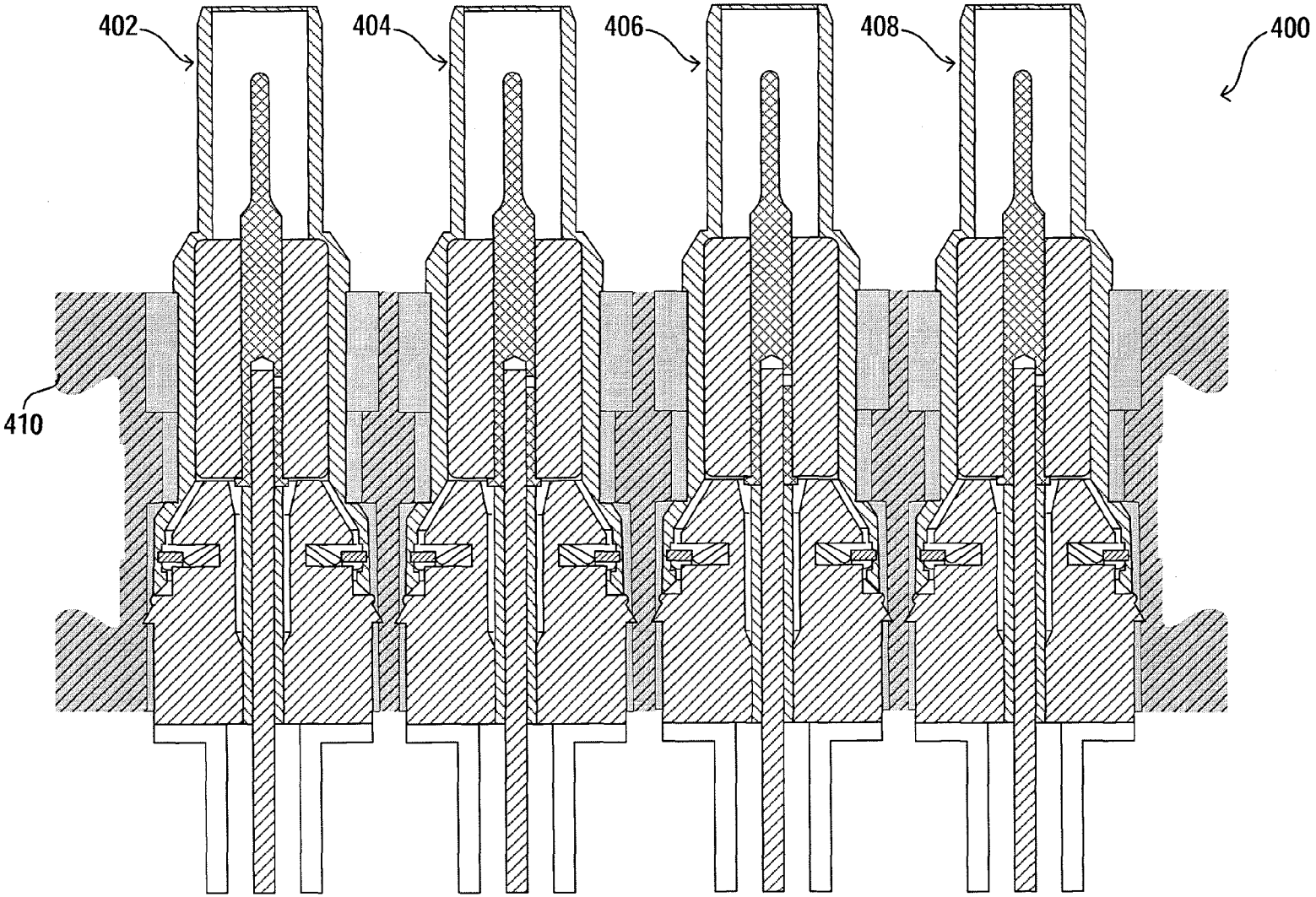
FIG. 4A is a cut-away side view of a self-adjusting plug connector having a plurality of plug assemblies according to an implementation of the present disclosure.

FIG. 4A shows a cut-away side view of a self-adjusting plug connector 400 having a plurality of plug assemblies (402, 404, 406, 408). Certain structural or operational features of the plug connector 400 may be the same as or similar to the previous descriptions for FIGS. 1-3C. Each of the four plug assemblies (402, 404, 406, 408) may be the same as or similar to the plug assemblies previously described above in FIGS. 1-3C. An outer molding 410 operates to mechanically couple each of the four plug assemblies (402, 404, 406, 408) together in order to form a stable unit. Although four plug assemblies (402, 404, 406, 408) are shown in FIG. 4A, an alternative implementation may utilize any number of plug assemblies coupled by the outer molding 410 to form the plug connector 400.

Figure 4B:
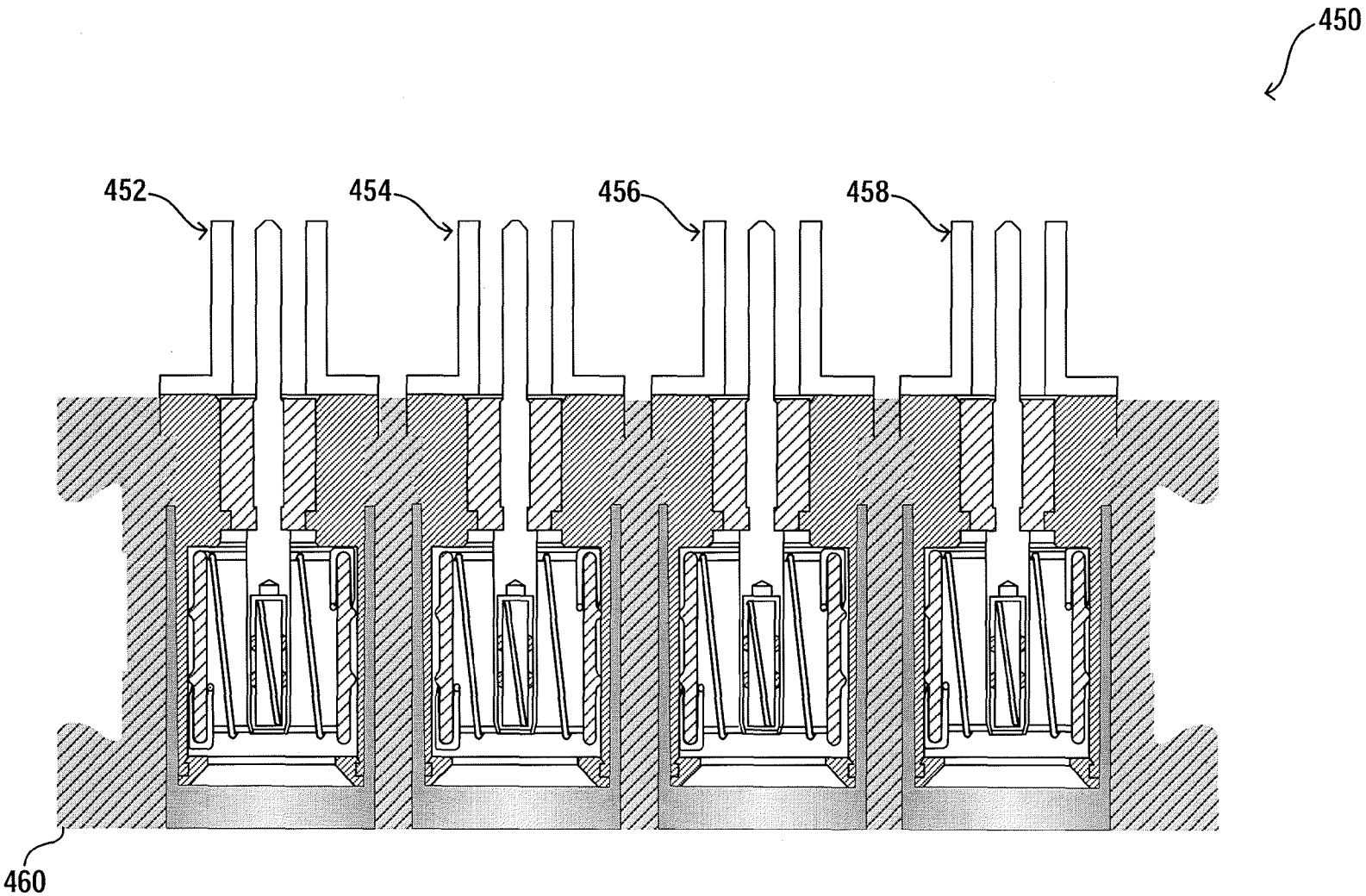
FIG. 4B is a cut-away side view of a receptacle connector having a plurality of receptacle assemblies according to an implementation of the present disclosure.

Similarly, FIG. 4B shows a cut-away side view of a self-adjusting receptacle connector 450 having a plurality of receptacle assemblies (452, 454, 456, 458). Each of the plurality of receptacle assemblies (452, 454, 456, 458) is configured or adapted to mate with a corresponding plug assembly (e.g., the plurality of plug assemblies (402, 404, 406, 408) of plug connector 400 shown in FIG. 4A). Certain structural or operational features of the receptacle connector 450 may be the same as or similar to the previous description for FIGS. 1-4A. Each of the four receptacle assemblies (452, 454, 456, 458) may be the same as or similar to receptacle assemblies previously described above in FIGS. 2-3C. An outer molding 460 operates to mechanically couple each of the four receptacle assemblies (452, 454, 456, 458) together in order to form a stable unit. Although four receptacle assemblies (452, 454, 456, 458) are shown in FIG. 4B, an alternative implementation may utilize any number of receptacle assemblies coupled by the outer molding 460 to form the receptacle connector 450.

Figure 5:
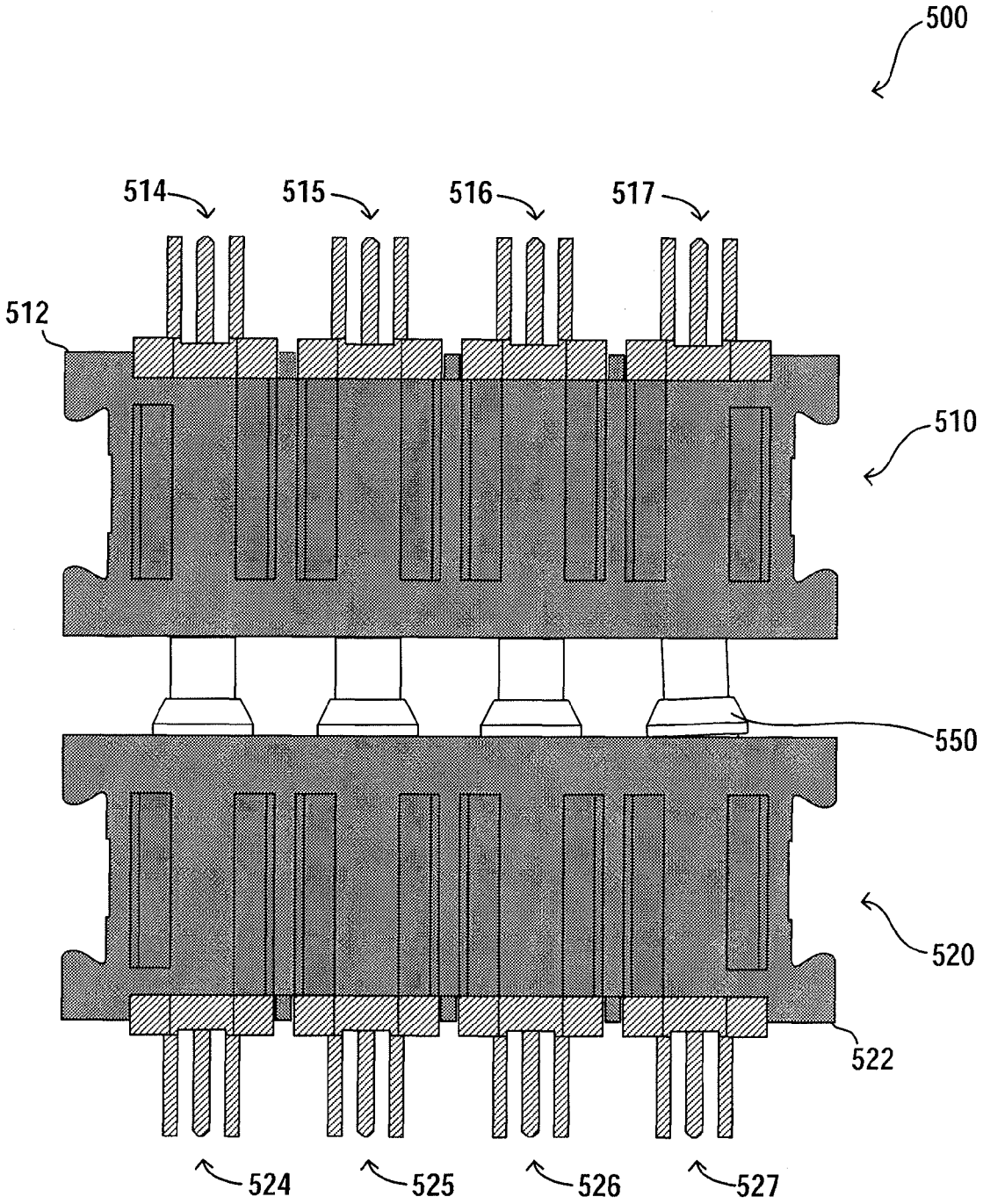
FIG. 5 is a side view of a plurality of plug assemblies coupled via an outer molding mated with a plurality of receptacle assembles coupled via an outer molding, with one of the plug assembly and receptacle assembly pairs in an intermediate stage according to an implementation of the present disclosure.

FIG. 5 shows a side view of a mated-pair electrical connector 500 when in a nearly final stage of the mating process. A receptacle connector 510 (e.g., the receptacle connector 450 of FIG. 4B) includes a plurality of receptacle assemblies (514, 515, 516, 517) coupled together by a molding 512. Each of the receptacle assemblies (514, 515, 516, 517) may be rigidly fastened and in electrical connection with a receptacle PCB (not shown), the same as or similar to as previously discussed. Likewise, a plug connector 520 (e.g., the plug connector 400 of FIG. 4A) includes a plurality of plug assemblies (524, 525, 526, 527) coupled together by a molding 522. Each of the plug assemblies (524, 525, 526, 527) may be rigidly fastened and in electrical connection with a plug PCB (not shown), the same as or similar to as previously discussed.

Each of the plurality of plug assemblies (524, 525, 526, 527) corresponds to one of the plurality of receptacle assemblies (514, 515, 516, 517) such that they are received by the receptacle assemblies (514, 515, 516, 517) when the electrical connector 500 is in the mated configuration. As shown, both the receptacle connector 510 and the plug connector 520 are allowed to mate and maintain electrical conductivity even during a misalignment between a plug portion 550 of the plug assembly 527 that does not precisely line up with the corresponding receptacle assembly 517, the same as or similar to the previous discussions for FIGS. 1-3C. The plug assemblies (524, 525, 526) and the receptacle assemblies (514, 515, 516) are in a fully mated configuration. The plug assembly 527 and the receptacle assembly 517 are in an intermediate stage of mating to better illustrate the plug portion 550 being misaligned. When fully mated, the plug portion 550 would be vertical and not angled, similar to the second portion 310 FIG. 3C. In this manner, electrical signals may still be properly transmitted through the electrical connector 500 without stressing or risking damage or breakage to the rigid electrical connections at one or both of the PCBs.

Although the implementations previously described have shown various connector components as integrated or coupled to a plug assembly or a receptacle assembly, the gender of each assembly may be reversed or certain features of the plug assembly may be incorporated into the receptacle assembly and vice versa in an alternative implementation. An alternative implementation may also utilize greater or fewer connector components than have been described for the implementations above. In one example, a retaining ring and/or a flexible wire may be utilized in both or either a plug assembly and/or receptacle assembly for allowing movement of a portion of the plug assembly and/or receptacle assembly.

Exemplary implementations of the present disclosure have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such implementations that reasonably fall within the scope of the advancement to the art hereby contributed, and that that scope shall not be restricted, except in light of the appended claims and their equivalents.

What is claimed is:

1. A mated pair electrical connector for providing electrical conductivity between a first printed circuit board (PCB) and a second PCB, the electrical connector comprising:

a plug assembly configured to rigidly connect to the first PCB and having:

a plug outer conductor defining a cavity therein, an inner pin disposed within the cavity, a flexible wire connected to the inner pin, and a rear tail surrounding the flexible wire and coupled to the outer conductor via a retaining ring, the retaining ring configured to allow movement of the plug outer conductor with respect to the rear tail; and a receptacle assembly configured to rigidly connect to the second PCB and having:

a receptacle outer conductor defining a cavity therein, a wire basket disposed within the cavity and configured to engage the plug outer conductor and apply a force to the plug outer conductor for moving the plug outer conductor with respect to the rear tail when the plug assembly is mated with the receptacle assembly, and a conductive socket wire basket disposed within the cavity and configured to receive the inner pin when the plug assembly is mated with the receptacle assembly.

2. The mated pair electrical connector of claim 1, wherein the plug assembly further comprising a plug protrusion fixedly engaged with the rear tail and configured to electrically connect to the first PCB.

3. The mated pair electrical connector of claim 2, wherein the inner pin is electrically connected to the plug protrusion.

4. The mated pair electrical connector of claim 1, wherein a non-conductive material surrounds the flexible wire.

5. The mated pair electrical connector of claim 1, wherein the plug outer conductor has a bullet-nose shape.

6. The mated pair electrical connector of claim 1, wherein the retaining ring is conductive to maintain electrical conductivity between the plug outer conductor and the rear tail.

7. The mated pair electrical connector of claim 1, wherein the receptacle outer conductor has a hyperboloid shape.

8. The mated pair electrical connector of claim 1, wherein the wire basket comprises a ferrule wound with a wire.

9. The mated pair electrical connector of claim 1, wherein the receptacle assembly further comprises a receptacle protrusion.

10. The mated pair electrical connector of claim 9, wherein the receptacle protrusion is electrically connected to the conductive socket wire basket.

11. An electrical connector comprising:

a plug assembly having a plug central axis and comprising:

a plug outer body defining a plug cavity therein, a conductive pin disposed within the plug cavity, a dielectric insulator disposed around the conductive pin and separating the conductive pin from the plug outer body, a conductive flexible wire connected to the conductive pin, a flexible material disposed around the conductive flexible wire, a rear tail movably connected to the plug outer body independent of the conductive flexible wire via a retaining ring such that the plug outer body can float with respect to the rear tail, a first plug protrusion connected to the rear tail, and a second plug protrusion connected to the conductive flexible wire; and a receptacle assembly having a receptacle central axis and comprising:

a receptacle outer body defining a receptacle cavity therein, a wire basket disposed within the receptacle cavity and configured to engage the plug outer body and apply a force to the plug outer body such that the plug outer body shifts to allow the plug central axis to align with the receptacle central axis, a conductive socket wire basket disposed within the receptacle cavity and configured to receive the conductive pin, a first receptacle protrusion connected to the receptacle outer body, and a second receptacle protrusion electrically connected to the conductive socket wire basket.

12. The electrical connector of claim 11, wherein the plug outer body is non-conductive.

13. The electrical connector of claim 11, wherein the receptacle outer body is non-conductive.

14. The electrical connector of claim 11, wherein the receptacle assembly further comprises a conductive portion connecting the conductive socket wire basket to the second receptacle protrusion.

15. The electrical connector of claim 11, wherein the first plug protrusion carries a ground signal.

16. The electrical connector of claim 11, wherein the first receptacle protrusion carries a ground signal.

17. The electrical connector of claim 11, wherein the wire basket defines a wire basket cavity and the conductive wire basket is further disposed within the wire basket cavity.

18. An electrical connector comprising:

a plurality of plug assemblies, each of the plurality of plug assemblies comprising:

a plug outer conductor defining a cavity therein, an inner pin disposed within the cavity, a flexible wire connected to the inner pin, and a rear tail surrounding the flexible wire and coupled to the outer conductor via a retaining ring, the retaining ring configured to allow movement of the plug outer conductor with respect to the rear tail; and a plurality of receptacle assemblies, each of the plurality of receptacle assemblies configured to mate respectively with each of the plurality of plug assemblies and comprising:

a receptacle outer conductor defining a cavity therein, a wire basket disposed within the cavity and configured to engage the plug outer conductor of a respective plug assembly and apply a force to the plug outer conductor of the respective plug assembly for moving the plug outer conductor of the respective plug assembly with respect to the rear tail of the respective plug assembly when the respective plug assembly is mated with the receptacle assembly, and a conductive socket wire basket disposed within the cavity and configured to receive the inner pin of the respective plug assembly when the respective plug assembly is mated with the receptacle assembly.

19. The electrical connector of claim 18, further comprising a plug outer molding surrounding the plurality of plug assemblies.

20. The electrical connector of claim 18, further comprising a receptacle outer molding surround the plurality of receptacle assemblies.

* * * * *